US009558662B2

(12) United States Patent
Nomoto

(10) Patent No.: US 9,558,662 B2
(45) Date of Patent: Jan. 31, 2017

(54) TRAVELING ENVIRONMENT EVALUATION SYSTEM

(71) Applicant: TOYOTA JIDOSHA KABUSHIKI KAISHA, Toyota-shi, Aichi-ken (JP)

(72) Inventor: Hirokazu Nomoto, Tokyo (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 15/000,211

(22) Filed: Jan. 19, 2016

(65) Prior Publication Data

US 2016/0293005 A1 Oct. 6, 2016

(30) Foreign Application Priority Data

Apr. 1, 2015 (JP) ..... 2015-075328

(51) Int. Cl.
*G08G 1/09* (2006.01)
*G08G 1/0967* (2006.01)

(52) U.S. Cl.
CPC ..... *G08G 1/096775* (2013.01)

(58) Field of Classification Search
CPC ..... B60W 2550/402; B60W 40/09; B60W 2050/0077; B60W 2050/146; B60W 2550/12; B60W 2550/14; B60W 30/00; B60W 2540/30; B60W 2550/10; B60W 2550/22; B60W 30/12; G08G 1/0104; G08G 1/0133; G08G 1/017
USPC ..... 340/576, 435, 990, 905, 425.5, 441,340/573.1, 439, 670; 701/22, 117, 31.4, 537, 701/58, 70, 24, 41, 408, 428, 412
See application file for complete search history.

(56) References Cited

U.S. PATENT DOCUMENTS

2009/0082917 A1* 3/2009 Adachi ..... G08G 1/0104 701/420
2015/0206431 A1* 7/2015 Park ..... B60K 28/00 701/1
2016/0207458 A1* 7/2016 Pillai ..... G06K 9/00791

FOREIGN PATENT DOCUMENTS

| | | | |
|---|---|---|---|
| JP | 2000-076593 | A | 3/2000 |
| JP | 2002-230679 | A | 8/2002 |
| JP | 2004-171159 | A | 6/2004 |
| JP | 2008-139320 | A | 6/2008 |
| WO | 2014/167701 | A1 | 10/2014 |

* cited by examiner

*Primary Examiner* — Dhaval Patel
(74) *Attorney, Agent, or Firm* — Sughrue Mion, PLLC

(57) ABSTRACT

A display section classifies evaluation values of a first traveling environment into a plurality of classes to obtain levels of ease of driving and displays the levels of ease of driving for each of unit areas including one or a plurality of areas. The display section displays levels of ease of driving calculated based on evaluation values of a second traveling environment as replacement for first unit areas including areas in a level of ease of driving displaced from a median.

10 Claims, 11 Drawing Sheets

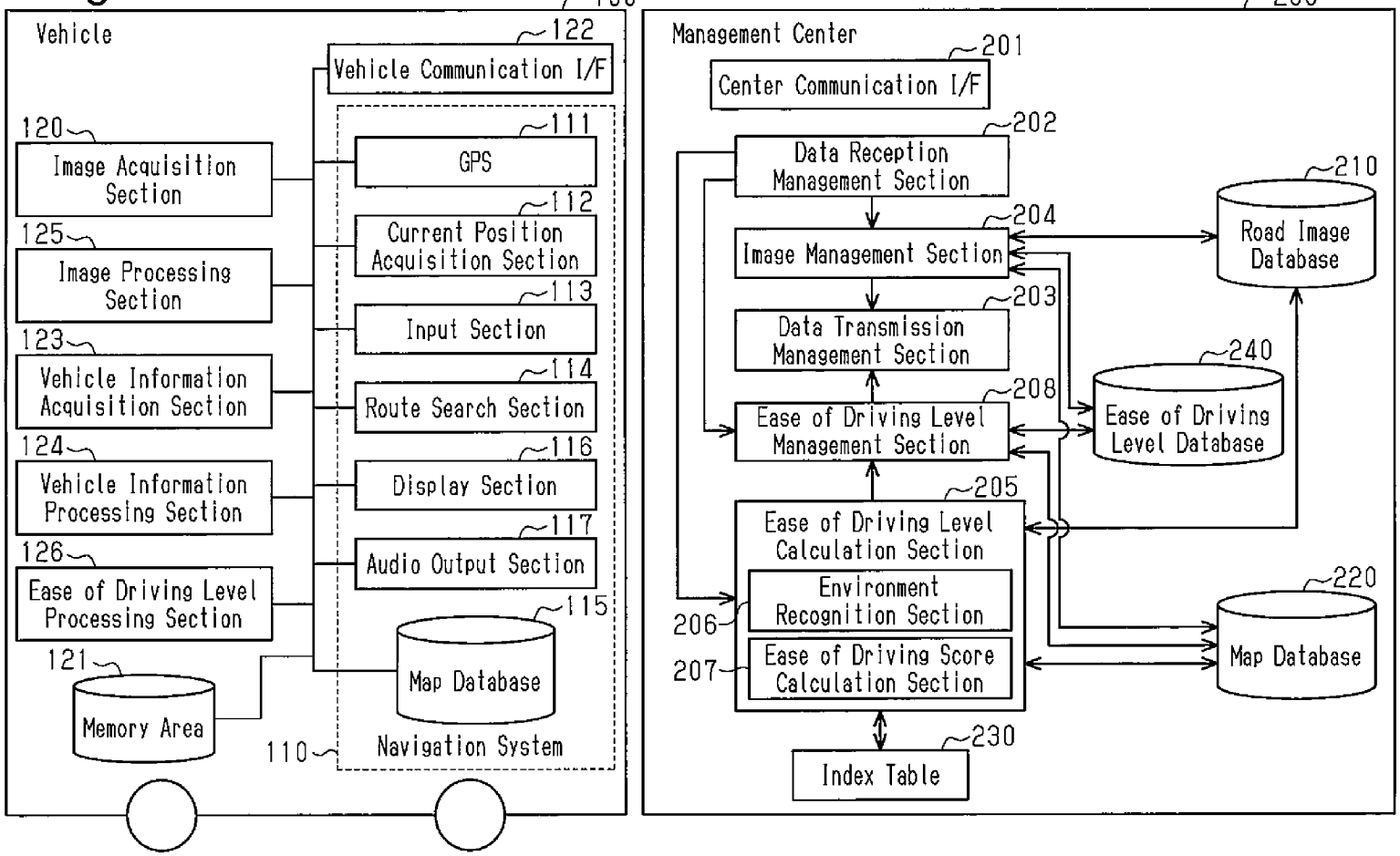
Fig.1
Vehicle
100
Vehicle Communication I/F
122
GPS
111
Current Position Acquisition Section
112
Input Section
113
Route Search Section
114
Display Section
116
Audio Output Section
117
Map Database
115
Navigation System
110
Image Acquisition Section
120
Image Processing Section
125
Vehicle Information Acquisition Section
123
Vehicle Information Processing Section
124
Ease of Driving Level Processing Section
126
Memory Area
121
Management Center
200
Center Communication I/F
201
Data Reception Management Section
202
Image Management Section
204
Data Transmission Management Section
203
Ease of Driving Level Management Section
208
Ease of Driving Level Calculation Section
205
Environment Recognition Section
206
Ease of Driving Score Calculation Section
207
Index Table
230
Road Image Database
210
Ease of Driving Level Database
240
Map Database
220

Fig.2

| # | Abbreviation | Name | Data | Note |
|---|---|---|---|---|
| 1 | $S_{ECO}$ | Static Ease of Driving Score | Numerical Value | Calculate from Map DB (Static) |
| 2 | $D_{ECO}$ | Dynamic Ease of Driving Score | Numerical Value | Calculate from Environment Information (Dynamic) |
| 3 | $T_{ECO}$ | Ease of Driving Score from Environment Information | Numerical Value | $S_{ECO}-D_{ECO}$ (Total) |
| 4 | $LT_{ECO}$ | Ease of Driving Level from Environment Information | A~E | Convert from $T_{ECO}$ (Level) |
| 5 | $MLT_{ECO}$ | Ease of Driving Level of LV.4 Road Link | A~E | Calculate by The Present Technique (Round Off) |
| 6 | $C_{ECO}$ | Ease of Driving Score from Vehicle Information | Numerical Value | Calculate by The Present Technique (CAN) |
| 7 | $LC_{ECO}$ | Ease of Driving Level from Vehicle Information | A~E | Convert from $C_{ECO}$ |

Fig.3

| No | CAN Data | Reason | Item of Data Used |
|---|---|---|---|
| 1 | Steering Angle | Angle varies depending on obstacle | Difference between maximum and minimum, Operation Time |
| 2 | Estimated Vehicle Body Acceleration | Acceleration varies depending on presence or absence of obstacle and type of obstacle | Difference between maximum and minimum, Maximum Value |
| 3 | Accelerator Opening | Opening is proportional to increase in acceleration | Maximum Value |
| 4 | Speed | Speed varies depending on presence or absence of obstacle and type of obstacle | Difference between maximum and minimum |

Fig.4

| Item | Example |
|---|---|
| Road Type | Expressway/National Highway/Prefectural Road, Etc. |
| Number of Lanes | One Lane/Two Lanes/Three Lanes/Four or More Lanes |
| Sidewalk Installation Condition | None/Less than 2 m/ 2 m or More |
| Shoulder Installation Condition | Less than 50 cm / 50 to 75 cm, etc. |
| Road Width | 3.0 m or Less / 3.0 to 4.0 m, etc. |
| Speed Limit | 30 km/h, Etc. |

Fig.5

| Static Ease of Driving Score ($S_{EOD}$) |
|---|
| 100 |
| 80 |
| 60 |
| 40 |

Fig.6

| Ease of Driving Score from Environment Information ($T_{EOD}$) | Ease of Driving Factor Classification | Ease of Driving Factor Element | Score |
|---|---|---|---|
| 45 | Road Structure Factor | One Lane Road With Sidewalk | 80 |
| | Road Environment | Telephone Pole Sticking Out | -15 |
| | Traffic Condition | Pedestrian | -10 |
| | Weather Condition | Rain | -10 |
| ... | ... | ... | ... |

Fig.7

| | Ease of Driving Level ($LT_{ECO}$) from Environment Information | Ease of Driving Score ($T_{ECO}$) from Environment Information |
|---|---|---|
| Easy To Drive | A | 80 or more |
| ↑ | B | 60 or more and less than 80 |
| | C | 40 or more and less than 60 |
| ↓ | D | 20 or more and less than 40 |
| Hard To Drive | E | Less than 20 |

Fig.8

240

| Road Link ID | Road Image ID | Ease of Driving Level ($LT_{ECO}$) from Environment Information | Ease of Driving Score ($C_{ECO}$) from Vehicle Information | Reception Time |
|---|---|---|---|---|
| 0200001 | 00001 | C | 3.12 | Y/M/D/Time |
| ⋮ | ⋮ | ⋮ | ⋮ | ⋮ |

Fig.9

| | Ease of Driving Level ($LC_{ECO}$) from Vehicle Information | Ease of Driving Score ($C_{ECO}$) from Vehicle Information | |
|---|---|---|---|
| Easy To Drive | A | Less Than 1.5 | Small |
| ↑ | B | 1.5 or more and less than 2.5 | ↑ |
| | C | 2.5 or more and less than 3.5 | |
| ↓ | D | 3.5 or more and less than 4.5 | ↓ |
| Hard To Drive | E | 4.5 or More | Large |

TRAVELING ENVIRONMENT EVALUATION SYSTEM

BACKGROUND OF THE DISCLOSURE

The present disclosure relates to a traveling environment evaluation system that evaluates a traveling environment indicating ease of driving of a vehicle and that displays an evaluation result.

An example of a conventionally known traveling environment evaluation system of this type includes a system described in International Publication No. WO2014/167701. In this system, image data collected from a plurality of vehicles during traveling of the vehicles is analyzed to identify a road environment, traffic conditions, and weather conditions for each of predetermined areas. The system calculates an evaluation value of a traveling environment indicating ease of driving of the vehicle for each of corresponding areas based on items prescribed in the identified road environment, traffic conditions, and weather conditions. The system converts the evaluation values of the areas into levels of ease of driving prescribed in a plurality of classes and then displays criteria of the ease of driving on a monitor mounted on the vehicle.

Conventional systems of this type including the system described in International Publication No. WO2014/167701 usually separately display the levels of ease of driving of the vehicles, for each unit area including one or a plurality of areas. When the size of the unit area is to be changed along with expansion of the display scale or the like, even if an average value, a minimum value, or a maximum value of the levels of ease of driving of a plurality of areas included in the unit area is handled as a representative value, the representative value may not accurately reflect the level of ease of driving of the actual traveling environment in the unit area. Therefore, the display of the level of ease of driving using the representative value may give an uncomfortable feeling to the occupant of the vehicle.

An objective of the present disclosure is to provide a traveling environment evaluation system that can display evaluation of ease of driving for each unit area without giving an uncomfortable feeling to the occupant of the vehicle even when the size of the unit area to be displayed is changed.

SUMMARY

In accordance with one aspect of the present disclosure, a traveling environment evaluation system is provided that includes a first traveling environment evaluation section, a second traveling environment evaluation section, and a display section. The first traveling environment evaluation section is configured to calculate an evaluation value of a first traveling environment for each of predetermined areas. The first traveling environment evaluation section sets, as the first traveling environment, a traveling environment indicating ease of driving of a vehicle based on information related to at least one of elements including a road environment, traffic conditions, and weather conditions. The second traveling environment evaluation section is configured to calculate an evaluation value of a second traveling environment for each of the predetermined areas. The second traveling environment evaluation section sets, as the second traveling environment, a traveling environment indicating ease of driving of the vehicle based on parameters indicating a traveling state of the vehicle. The display section is configured to classify the evaluation values of the first traveling environment into a plurality of classes to obtain levels of ease of driving. The display section displays the level of ease of driving for each of unit areas including one or a plurality of areas. First unit areas including areas in a level displaced from a median of the classified levels of ease of driving exist when the display section enlarges a size of the unit areas to be displayed. The display section is configured to obtain the evaluation values of the second traveling environment of the areas in the level of ease of driving displaced from the median. The display section is configured to display a level of ease of driving calculated based on the evaluation values of the second traveling environment as a replacement for the first unit areas including the areas in the level of ease of driving displaced from the median.

In general, when the level of ease of driving of the vehicle in a unit area is simply calculated by averaging the levels of ease of driving of the vehicle based on external elements, such as a road environment, traffic conditions, and weather conditions, of the areas that are constituent elements of the unit area regardless of the traveling state of the vehicle from moment to moment, the calculated level tends to be biased toward the median of a plurality of classified levels. Therefore, when the subject unit area includes an area of a level displaced from the median, the level of ease of driving of the vehicle obtained by averaging may give an uncomfortable feeling to the occupant of the vehicle actually in the traveling state. In this regard, according to the configuration, if an area of the level displaced from the median is included when the unit area to be displayed is enlarged, the level of ease of driving calculated based on the evaluation values of the traveling environment based on the parameters indicating the traveling state of the vehicle in the area is displayed as a replacement. Since the obtained level is displayed as a replacement for the level of ease of driving in the unit area, the occupant of the vehicle actually in the traveling state can easily sense the level, and discrepancy between a sensible value of the occupant of the vehicle and a display value can be prevented. Therefore, even when the size of the unit area to be displayed is changed, the evaluation of the ease of driving of the vehicle for each unit area can be displayed without giving an uncomfortable feeling to the occupant of the vehicle.

In accordance with one form of the present disclosure, when calculating the levels of ease of driving based on the evaluation values of the second traveling environment, the display section is preferably configured to obtain the levels of ease of driving, which are obtained by classifying the evaluation values of the second traveling environment into a plurality of classes, and the median. The display section is preferably configured to set the level of ease of driving based on the evaluation value of the second traveling environment to the level to be displayed as a replacement by the display section on the condition that the level of ease of driving based on the evaluation value of the second traveling environment is displaced from the median of the second traveling environment.

According to the above configuration, the level displaced from the median is displayed as a replacement for the level of ease of driving of the vehicle in the unit area on the condition that the unit area includes an area in which both of the level of ease of driving of the vehicle based on the information related to at least one of the elements of the road environment, the traffic conditions, and the weather conditions and the level of ease of driving of the vehicle based on the parameters indicating the traveling state of the vehicle are displaced from the median of the classified levels.

Therefore, the level of ease of driving closer to the feeling of the occupant of the vehicle can be displayed.

In accordance with one form of the present disclosure, second unit areas not including the areas in the level displaced from the median preferably exist when the unit areas to be displayed by the display section are enlarged. The display section is preferably configured to calculate the levels of ease of driving of the second unit areas based on an average value of the evaluation values of the first traveling environment in the areas included in the second unit areas. The display section is preferably configured to display the calculated levels of ease of driving of the second unit areas for each of the second unit areas.

In general, if the areas included in the unit area do not include an area in which the level of ease of driving of the vehicle based on the information related to at least one of the elements including the road environment, the traffic conditions, and the weather conditions is displaced from the median, the levels of the areas have values closer to the median from the beginning. Therefore, even if the level of ease of driving of the vehicle in the unit area is calculated by averaging according to the configuration, the discrepancy between the calculated level and the sensible value of the occupant of the vehicle is prevented.

In accordance with one form of the present disclosure, the display section is preferably configured to display the levels of ease of driving of the vehicle evaluated by the first traveling environment evaluation section or the second traveling environment evaluation section for each of the predetermined areas along with a road map of corresponding areas. The display section is preferably configured to enlarge the size of the first unit areas or the second unit areas to be displayed along with expansion of a scale of the road map corresponding to the first unit areas or the second unit areas.

According to the above configuration, the levels of ease of driving of the vehicle in the unit areas can be displayed without giving an uncomfortable feeling to the occupant of the vehicle even when the size of the unit areas to be displayed is changed along with the expansion of the scale of the road map.

In accordance with one form of the present disclosure, the display section is preferably configured to determine that a level at which the level of ease of driving of the vehicle is lower than a predetermined value is the level displaced from the median.

In general, if the evaluation of the area that tends to be hard to drive is diverged from the actual circumstances as a result of averaging, the occupant of the vehicle may have a strong uncomfortable feeling that the part is hard to drive when the vehicle actually travels the part. In this regard, according to the above configuration, the discrepancy between the sensible value of the occupant of the vehicle and the display value can be prevented for the evaluation of the area that tends to be hard to drive, i.e. for the display of the level of ease of driving in an area in which the level of ease of driving of the vehicle is lower than a predetermined value, and this favorably reduces the uncomfortable feeling of the occupant of the vehicle.

In accordance with one form of the present disclosure, the vehicle preferably includes a plurality of onboard control devices connected to a controller area network. The second traveling environment evaluation section is preferably configured to handle, as the parameters indicating the traveling state of the vehicle, parameters collected from the plurality of onboard control devices by communication prescribed in a CAN protocol.

According to the above configuration, the parameters indicating the traveling states of a variety of vehicles can be collected by using the highly versatile CAN protocol often used in the vehicles. Therefore, the levels of ease of driving of the vehicles in the unit areas can be displayed in a manner that the uncomfortable feeling of the occupant of the vehicle is further reduced.

In accordance with one form of the present disclosure, the first traveling environment evaluation section is preferably configured to calculate the evaluation value of the first traveling environment by executing the processes of:

a) calculating a base score by numerically evaluating structural factors of a road to be evaluated based on road map data in which information related to the road map is registered;

b) expressing a factor in drop of ease of driving of the vehicle in a numerical form based on analysis of the traveling environment indicated by information related to at least one of elements of the road environment, the traffic conditions, and the weather conditions; and c) calculating an index numerically evaluating the ease of driving of the vehicle by subtracting the factor in drop of ease of driving of the vehicle expressed in a numerical form from the base score.

According to the above configuration, static and dynamic elements can be taken into account to evaluate the traveling environment according to the actual circumstances.

In accordance with one form of the present disclosure, the traveling environment evaluation system preferably includes a management center that manages traveling information of a plurality of subject vehicles through wireless communication. The second traveling environment evaluation section is preferably provided in the management center. The second traveling environment evaluation section is preferably configured to evaluate the second traveling environment for each of the predetermined areas based on vehicle information received from the plurality of vehicles to obtain evaluation values of the second traveling environment to distribute the evaluation values of the second traveling environment to each of the vehicles. The display section is preferably provided on the vehicle. The display section is preferably configured to calculate the levels of ease of driving based on the evaluation values of the second traveling environment distributed from the management center. The display section is preferably configured to display the calculated levels of ease of driving as a replacement.

According to the above configuration, the management center computes the evaluation values of the second traveling environment, and the processing load in the vehicles can be reduced. Since the management center integrates the evaluation values of the traveling environment based on the parameters indicating the traveling states of the vehicles received from a plurality of vehicles, the map range in which the evaluation values can be obtained is enlarged, and the versatility of the map is increased.

In accordance with one form of the present disclosure, the traveling environment evaluation system preferably includes a management center that manages traveling information of a plurality of subject vehicles through wireless communication. The second traveling environment evaluation section is preferably provided on each of the vehicles. The second traveling environment evaluation section is preferably configured to evaluate the second traveling environment based on the vehicle information for each of the predetermined areas. The second traveling environment evaluation section is preferably configured to transfer the evaluation values of the second traveling environment to the management center.

The display section is preferably provided on each of the vehicle like the second traveling environment evaluation section. The display section is preferably configured to calculate the levels of ease of driving based on the evaluation values of the second traveling environment distributed from the management center. The display section is preferably configured to display the calculated levels of ease of driving as a replacement.

According to the above configuration, since the vehicle computes the evaluation values of the second traveling environment, the parameters indicating the traveling state of the vehicle do not have to be transferred from the vehicle to the management center, and the communication load between the vehicle and the management center can be reduced. Since the management center integrates the evaluation values of the traveling environment received from a plurality of vehicles, the map range in which the evaluation values can be obtained is enlarged, and the versatility of the map is increased.

Other aspects and advantages of the discloser will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the presently preferred embodiments together with the accompanying drawings in which:

FIG. 1 is a block diagram showing a schematic configuration of a traveling environment evaluation system according to a first embodiment;

FIG. 2 is a diagram showing content of various parameters used by the traveling environment evaluation system of the first embodiment;

FIG. 3 is a diagram showing content of parameters related to a traveling state of a vehicle;

FIG. 4 is a diagram showing an example of sorting of road structure factors in environment information;

FIG. 5 is a diagram showing classes of base scores calculated based on the road structure factors;

FIG. 6 is a diagram showing an example of ease-of-driving scores from environment information and additional information of the ease-of-driving scores;

FIG. 7 is a diagram showing a relationship between the ease-of-driving scores from environment information and ease-of-driving levels from environment information hierarchically prescribed according to the ease-of-driving scores;

FIG. 8 is a diagram showing an example of data content registered in an ease-of-driving level database;

FIG. 9 is a diagram showing a relationship between ease-of-driving scores from vehicle information and ease-of-driving levels from vehicle information hierarchically prescribed according to the ease-of-driving scores;

DESCRIPTION OF THE PREFERRED EMBODIMENTS

First Embodiment

Figure 10:
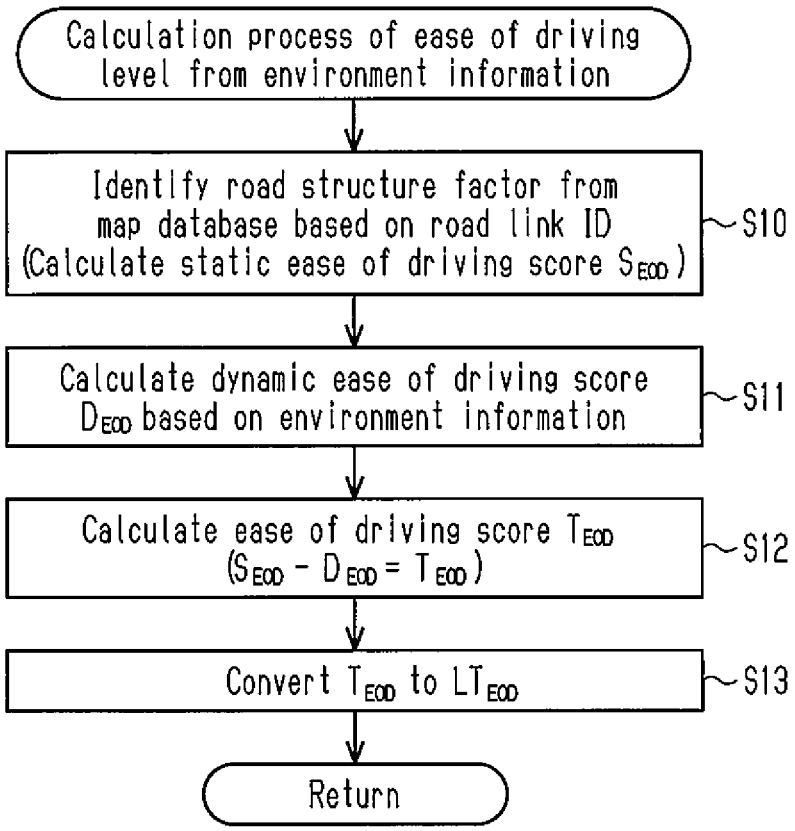
FIG. 10 is a flowchart showing an example of a process of calculating the ease-of-driving levels from environment information.

A traveling environment evaluation system according to a first embodiment will now be described with reference to the drawings.

The traveling environment evaluation system of the present embodiment includes a plurality of subject vehicles and a management center that manages traveling information of the plurality of vehicles through wireless communication. The management center evaluates, as a static ease-of-driving score, a base score serving as a basis for evaluating ease of driving based on information related to road structure factors, such as a road type and the number of lanes. The information related to the road structure factors is registered for each of road links that are areas divided by traffic elements, such as intersections, in a map database. Nodes that are constituent elements of the road links are sorted by road node type, in which expressways, national highways, and the like are higher road levels, and general prefectural roads, general city roads, and the like are lower road levels. Road links including only nodes in the higher road levels are set as higher road links, and road links with nodes included in the higher road levels and in any of the lower road levels are set as lower road links. The management center collects, through wireless communication, image data acquired each time the plurality of vehicles travel the road links and receives road traffic information and weather information from Japan Road Traffic Information Center (registered trademark). For each road link, the management center analyzes the collected data to numerically evaluate, as a dynamic ease-of-driving score, a factor that reduces the ease of driving of the vehicle, such as a road environment, traffic conditions, and weather conditions. The management center subtracts the dynamic ease-of-driving score from the static ease-of-driving score to calculate an ease-of-driving score from environment information in each of the road links. The ease-of-driving score from environment information is an evaluation value indicating the ease of driving of the vehicle based on environment information that is information related to elements, such as a road environment, traffic conditions, and weather conditions. The evaluation value indicates an evaluation value of a first traveling environment, which is the traveling environment of the road link, the evaluation value indicating the ease of driving of the vehicle. The vehicle guides the route of the vehicle when the vehicle travels the road link, based on the ease-of-driving score from the image data distributed from the management center. The image data corresponding to the road link collected by the management center is also used to guide the route. The vehicle also calculates an ease-of-driving score from vehicle information for each of the road links based on parameters indicating the traveling state of the vehicle, such as steering angle and acceleration during traveling of the vehicle. The ease-of-driving score from vehicle information is an evaluation value indicating the ease of driving of the vehicle based on the parameters indicating the traveling state of the vehicle. The evaluation value indicates an evaluation value of a second traveling environment which is the traveling environment of the road link, the evaluation value indicating the ease of driving of the vehicle. The vehicle transfers the calculated ease-of-driving score from vehicle information to the management center. To enlarge the size of the unit areas to be displayed in the map data used to guide the route of the vehicle, that is, to change the road links to be displayed from a lower level to a higher level, the vehicle displays the ease-of-driving levels corresponding to the road links of the higher level. In the display of the ease-of-driving levels, the vehicle uses not only the ease-of-driving levels in which the ease-of-driving scores from environment information in the road links of the lower level are classified into a plurality of classes, but also the ease-of-driving levels in which the ease-of-driving scores from vehicle information in the road links of the lower level are similarly classified into a plurality of classes.

Specifically, a vehicle 100 includes a navigation system 110, which guides the route of the vehicle 100, as shown in FIG. 1. The navigation system 110 includes a current position acquisition section 112, which acquires information related to the current position of the vehicle identified through a global positioning system (GPS) 111, and a route search section 114, which searches for an optimal route from the current position to the destination that is input and operated through an input section 113. The route search section 114 uses Dijkstra's algorithm or the like with reference to the ease-of-driving scores from environment information in each area distributed from a management center 200 to search for the optimal route on map data registered in a map database 115. The navigation system 110 indicates the guidance related to the optimal route searched by the route search section 114 by displaying the guidance on a guide screen of a display section 116 or by outputting audio guidance from an audio output section 117. Following sections of vehicle 100 are composed of vehicle ECUs (Electronic Control Units). Following sections of the management center 200 are composed of center ECUs.

The vehicle 100 further includes an image acquisition section 120, which captures images of conditions around the vehicle 100. The image acquisition section 120 is, for example, an onboard camera. When the vehicle 100 acquires image data through the image acquisition section 120, the vehicle 100 determines the road link ID with reference to the map database 115 based on the information related to the vehicle position acquired through the current position acquisition section 112 at this point. The vehicle 100 stores the image data in a memory area 121 in association with the determined road link ID and transfers the image data stored in the memory area 121 to the management center 200 through a communication interface (hereinafter, referred to as vehicle communication I/F) 122.

The vehicle 100 further includes a vehicle information acquisition section 123, which acquires parameters indicating the traveling state of the vehicle from various onboard control devices through a vehicle network such as a CAN (controller area network). The various onboard control devices include an engine control device, which controls operation of the engine, a brake control device, which controls operation of the brakes, and a steering control device, which controls assistance in the steering operation. The parameters indicating the traveling state of the vehicle acquired from the onboard control devices are used to calculate the ease-of-driving score from vehicle information indicating the evaluation value of the second traveling environment, which is the traveling environment of the vehicle at the acquisition of the parameters, the evaluation value indicating the ease of driving of the vehicle. The ease-of-driving score from vehicle information is calculated for each of predetermined areas, e.g. each of road links of lower levels such as Lv.2 (level 2) road links. The Lv.2 road links consist of nodes included in roads with a road level 2 or higher. A vehicle information processing section 124, which calculates the ease-of-driving score from vehicle information, functions as a second traveling environment evaluation section.

As shown in FIG. 2, the ease-of-driving score from vehicle information is numerical data expressed by an abbreviation $C_{EOD}$. A smaller value indicates that the vehicle tends to be easy to drive. As shown in FIG. 3, examples of parameters used for the calculation include "difference between maximum and minimum steering angles," "operation time of steering angle," "difference between maximum and minimum estimated vehicle body accelerations," "maximum value of estimated vehicle body acceleration," "maximum value of accelerator opening," and "difference between maximum and minimum speeds."

The reason that the "difference between maximum and minimum steering angles" and the "operation time of steering angle" are used is that these parameters vary depending on the type of obstacle that affects the ease of driving of the vehicle, and the parameters can be indices indicating the ease of driving of the vehicle. For example, a large "difference between maximum and minimum steering angles" denotes that the vehicle avoids the obstacle widely to the left or right, and this suggests that obstacles, such as pedestrians, tend to not avoid vehicles in this area. Therefore, an estimate of a large ease-of-driving score $C_{EOD}$ of the vehicle is made in such an area. On the other hand, a small "difference between maximum and minimum steering angles" denotes that the vehicle does not avoid the obstacle much to the left or right, and this suggests that obstacles, such as pedestrians, tend to avoid vehicles in this area. Therefore, an estimate of a small ease-of-driving score $C_{EOD}$ of the vehicle is made in such an area.

The reason that the "difference between maximum and minimum estimated vehicle body accelerations" and the "maximum value of estimated vehicle body acceleration" are used is that these parameters vary depending on the presence or absence of an obstacle and the type of the obstacle that affect the ease of driving of the vehicle, and the parameters can be indices indicating the ease of driving of the vehicle. For example, a large "difference between maximum and minimum estimated vehicle body accelerations" denotes that a deceleration state and an acceleration state are rapidly switched in the vehicle, and this suggests that obstacles, such as pedestrians, tend to not avoid vehicles in this area. Therefore, an estimate of a large ease-of-driving score $C_{EOD}$ of the vehicle is made in such an area. On the other hand, a small "difference between maximum and minimum estimated vehicle body accelerations" denotes that the deceleration state and the acceleration state are gently switched in the vehicle, and this suggests that obstacles, such as pedestrians, tend to avoid vehicles in this area. Therefore, an estimate of a small ease-of-driving score $C_{EOD}$ of the vehicle is made in such an area.

The reason that the "maximum value of accelerator opening" is used is that this parameter is proportional to the vehicle body acceleration, and the vehicle body acceleration can be an index indicating the ease of driving of the vehicle as described above. The reason that the "difference between maximum and minimum speeds" is used is that this parameter varies depending on the presence or absence of an obstacle and the type of the obstacle that affects the ease of driving of the vehicle, like the "difference between maximum and minimum estimated vehicle body accelerations", and the parameter can be an index indicating the ease of driving of the vehicle.

The parameters are used to calculate the ease-of-driving score $C_{EOD}$ from vehicle information based on the following regression equation (1).

$$C_{EOD}=A1\times(\text{difference between maximum and minimum steering angles})+A2\times\text{operation time of steering angle})+A3\times(\text{difference between maximum and minimum estimated vehicle body accelerations})+A4\times(\text{maximum value of estimated vehicle body acceleration})+A5\times(\text{maximum value of accelerator opening})+A6\times(\text{difference between maximum and minimum speeds}) \quad (1)$$

For weighting coefficients A1 to A6 used in regression equation (1), a negative value is set for the weighting coefficient if the corresponding parameter improves the ease of driving of the vehicle. On the other hand, a positive value is set for the weighting coefficient if the corresponding parameter hinders the ease of driving of the vehicle. For observed values of the parameters that serve as explanatory variables and set values of the ease-of-driving score $C_{EOD}$ from vehicle information that serve as objective variables corresponding to the observed values, regression analysis that is a method of analyzing the functional relation between population means of the observed values and the set values is used to verify the significance of regression equation (1) in advance.

As shown in FIG. 1, when the vehicle information processing section 124 acquires the vehicle information, the vehicle information processing section 124 determines the road link with reference to the map database 115 based on the information related to the vehicle position acquired through the current position acquisition section 112 at this point. The vehicle information processing section 124 also stores the ease-of-driving score $C_{EOD}$ from vehicle information in the memory area 121 in association with the determined road link. The vehicle 100 transfers the ease-of-driving score $C_{EOD}$ associated with the road link stored in the memory area 121 to the management center 200 through the vehicle communication I/F 122.

Meanwhile, the management center 200 includes a communication interface (hereinafter, referred to as center communication I/F) 201, which communicates with the vehicle communication I/F 122. The center communication I/F 201 also communicates with Japan Road Traffic Information Center, which manages road traffic information related to congestion, construction, accidents, and the like as well as weather information related to the weather of each area, earthquake warning, and the like.

The management center 200 includes a data reception management section 202, which manages reception of data by the center communication I/F 201, and a data transmission management section 203, which manages transmission of data by the center communication I/F 201. When the data reception management section 202 receives image data associated with the road link ID through the center communication I/F 201, the data reception management section 202 outputs the received image data to an image management section 204. When image data is input from the data reception management section 202, the image management section 204 outputs the image data to a road image database 210 in association with the road link ID. The road image database 210 integrates and manages image data collected from a plurality of vehicles 100 by the management center 200.

When the data reception management section 202 receives the road link ID corresponding to the current position of the vehicle through the center communication I/F 201 along with a request command for image data, the data reception management section 202 outputs the received road link ID to the image management section 204. The image management section 204 determines the current position of the vehicle on the map data with reference to a map database 220 based on the road link ID input from the data reception management section 202 and extracts road link IDs corresponding to the surroundings of the determined current position from the road image database 210. The image management section 204 reads the image data associated with the extracted road link IDs from the image data managed in the road image database 210 and outputs the image data to the data transmission management section 203. When the image data is input from the image management section 204, the data transmission management section 203 distributes the image data associated with the road link IDs to the vehicle 100 through the center communication I/F 201. The image data distributed from the management center 200 to the vehicle 100 is output to an image processing section 125 included in the vehicle 100 through the vehicle communication I/F 122. The image processing section 125 outputs and displays the input image data on the display section 116.

The management center 200 includes an ease-of-driving level calculation section 205, which calculates the ease-of-driving level from environment information by analyzing the image data registered in the road image database 210 and analyzing the road traffic information and the weather information received from Japan Road Traffic Information Center through the data reception management section 202. The ease-of-driving level calculation section 205 includes an environment recognition section 206, which that recognizes the road environment, the traffic conditions, and the weather conditions. The ease-of-driving level calculation section 205 numerically evaluates the ease-of-driving score from environment information through an ease-of-driving score calculation section 207 based on the recognition result of the environment recognition section 206.

The environment recognition section 206 applies an image recognition process to the image data read from the road image database 210 by designating the image ID to thereby analyze the conditions indicated by the image data for each item prescribed in, for example, the road environment, the traffic conditions, and the weather conditions and outputs the analysis result to the ease-of-driving score calculation section 207. The environment recognition section 206 similarly analyzes the road traffic information and the weather information acquired from Japan Road Traffic Information Center through the center communication I/F 201 for each item prescribed in, for example, the traffic conditions and the weather conditions and outputs the analysis result to the ease-of-driving score calculation section 207.

Various elements that affect the visibility of the road are prescribed as the items of the road environment, such as installation conditions of telephone poles, conditions of bicycle parking and street stalls sticking out to the road, on-street parking, road construction, and arrangement conditions of buildings. Various elements that obstruct traveling of the vehicle are prescribed as the items of the traffic conditions, such as the number and characteristics of pedestrians and bicycles (whether or not the pedestrians and the bicycles avoid the vehicle) and proportions of large vehicles and fixed route buses. Various elements are also prescribed as the items of the weather conditions, e.g. factors of poor visibility such as backlight, heavy rain, blizzard, and dense fog, factors affecting the drive operation such as strong wind and road surface freezing, and weather conditions such as rain and snow.

When the analysis result is input from the environment recognition section 206, the ease-of-driving score calculation section 207 refers to an index table 230 to calculate an index for each item prescribed in the road environment, the traffic conditions, and the weather conditions. The ease-of-driving score calculation section 207 calculates the sum of the indices calculated for the items, the sum serving as a dynamic ease-of-driving score that is numerical data indicated by an abbreviation $D_{EOD}$ as shown in FIG. 2.

The ease-of-driving score calculation section 207 also reads information related to road structure factors of the corresponding road link ID from the map database 220 and refers to the index table 230 to calculate an index for each item prescribed in the read road structure factors. The ease-of-driving score calculation section 207 calculates the sum of the indices calculated for the items, the sum serving as a static ease-of-driving score that is numerical data indicated by an abbreviation $S_{EOD}$ as shown in FIG. 2.

As shown in FIG. 4, the road structure factors are static factors related to the road, and for example, the road structure factors are sorted by item, such as road type, the number of lanes, sidewalk installation condition, shoulder installation condition, road width, and slope. The road type is sorted by, for example, expressway, national highway, and prefectural road. The number of lanes is sorted by, for example, the number of lanes. The sidewalk installation condition is sorted by, for example, presence or absence of sidewalk and width of sidewalk. The shoulder installation condition is sorted by predetermined width of shoulder, and the road width is sorted by predetermined width.

As shown in FIG. 5, the ease of driving is ranked based on the items of the road structure factors in the calculation of the static ease-of-driving score $S_{EOD}$ in the present embodiment. Scores 100, 80, 60, and 40 serving as bases in the calculation of the ease-of-driving score from environment information are allocated to the roads of the ranks. Each of the road links in lower levels, such as Lv.2 road links, is ranked in this way.

The ease-of-driving score calculation section 207 subtracts the dynamic ease-of-driving score $D_{EOD}$ from the static ease-of-driving score $S_{EOD}$ to calculate the ease-of-driving score from environment information. The ease-of-driving score from environment information is numerical data indicated by an abbreviation $T_{EOD}$ as shown in FIG. 2, and the ease-of-driving score from environment information indicates the evaluation value of the first traveling environment, which is the traveling environment of the vehicle corresponding to the environment information, the evaluation value serving as the ease of driving of the vehicle. The ease-of-driving score $T_{EOD}$ from environment information is calculated for each of predetermined areas, e.g. each of the road links in lower levels such as Lv.2 road links. The ease-of-driving score calculation section 207, which calculates the ease-of-driving score $T_{EOD}$ from environment information, functions as a first traveling environment evaluation section. A greater value of the ease-of-driving score $T_{EOD}$ from environment information indicates that the vehicle tends to be easy to drive.

In an example shown in FIG. 6, a subtraction element "15" based on the road environment, a subtraction element "10" based on the traffic conditions, and a subtraction element "10" based on the weather conditions are subtracted from a base score "80" to calculate an ease-of-driving score "45". In the present embodiment, the ease-of-driving score $T_{EOD}$ from environment information is calculated for each of the road links in lower levels, such as Lv.2 road links.

As shown in FIG. 7, the ease-of-driving level calculation section 205 ranks the ease-of-driving scores $T_{EOD}$ from environment information calculated through the ease-of-driving score calculation section 207 into five classes of A, B, C, D, and E and calculates an ease-of-driving level from environment information indicated by an abbreviation $LT_{EOD}$ as shown in FIG. 2. The level A is a level displaced from the level C, which is a median of the levels classified into five classes, and the level A is used as an evaluation result at a time that the calculated ease-of-driving $T_{EOD}$ is 80 or more. The level A indicates that the degree of the ease of driving of the evaluated road is the highest. The level E is a level lower than a predetermined value displaced from the level C, which is the median of the levels classified into five classes, and the level E is used as an evaluation result at a time that the calculated ease-of-driving score $T_{EOD}$ is less than 20. The level E indicates that the degree of the ease of driving of the evaluated road is the lowest.

As shown in FIG. 1, the ease-of-driving level calculation section 205 outputs the calculated ease-of-driving level $LT_{EOD}$ to an ease-of-driving level management section 208 in association with the image ID used to read the image data from the road image database 210 and in association with the road link ID to be analyzed.

When the ease-of-driving level $LT_{EOD}$ from environment information is input through the ease-of-driving level calculation section 205, the ease-of-driving level management section 208 outputs the ease-of-driving level $LT_{EOD}$ to an ease-of-driving level database 240 along with the image ID and the road link ID associated with the ease-of-driving level $LT_{EOD}$. The ease-of-driving level management section 208 also outputs the ease-of-driving score $C_{EOD}$ from vehicle information received through the data reception management section 202 to the ease-of-driving level database 240 along with the road link ID associated with the ease-of-driving score $C_{EOD}$.

As shown in FIG. 8, the ease-of-driving scores $C_{EOD}$ from vehicle information collected by the management center 200 from a plurality of vehicles 100 are integrated by an averaging process and managed in the ease-of-driving level database 240. The ease-of-driving levels $LT_{EOD}$ from environment information input through the ease-of-driving level calculation section 205 and the ease-of-driving scores $C_{EOD}$ from vehicle information input through the data reception management section 202 are associated based on the road link IDs and managed in the ease-of-driving level database 240 along with the road image IDs and the reception time.

When the data reception management section 202 receives the road link ID corresponding to the current position of the vehicle through the center communication I/F 201 along with the request command for the ease-of-driving level, the data reception management section 202 outputs the received road link ID to the ease-of-driving level management section 208. The ease-of-driving level management section 208 determines the current position of the vehicle on the map data with reference to the map database 220 based on the received road link ID and extracts the road link IDs corresponding to the surroundings of the determined current position from the ease-of-driving level database 240. The ease-of-driving level management section 208 reads the ease-of-driving levels $LT_{EOD}$ from environment information and the ease-of-driving scores $C_{EOD}$ from vehicle information associated with the extracted road links IDs from the data managed in the ease-of-driving level database 240 and outputs them to the data transmission management section 203. When the ease-of-driving levels $LT_{EOD}$ from environment information and the ease-of-driving scores $C_{EOD}$ from vehicle information are input from the ease-of-driving level management section 208, the data transmission management section 203 distributes the data to each vehicle 100 through the center communication I/F 201 in associated with the road link IDs.

As shown in FIG. 9, an ease-of-driving level processing section 126 ranks the ease-of-driving scores $C_{EOD}$ from vehicle information distributed from the management center 200 to each vehicle 100 into five classes of A, B, C, D, and E and calculates an ease-of-driving level from vehicle information indicated by an abbreviation $LC_{EOD}$ as shown in FIG. 2. The ease-of-driving level $LC_{EOD}$ from vehicle information, along with the ease-of-driving level $LT_{EOD}$ from environment information similarly distributed from the management center to each vehicle 100, is used by the ease-of-driving level processing section 126 to calculate the ease-of-driving level for each of Lv.4 (level 4) road links indicated by an abbreviation $MLT_{EOD}$ as shown in FIG. 2. The Lv.4 road links consist of nodes included in roads with a road level 4 or higher. The Lv.4 road links are higher than the Lv.2 road links as described above, and the Lv.4 road links are formed by integrating a plurality of Lv.2 road links. Therefore, the size of the corresponding areas on the map data is also large. The calculated ease-of-driving levels $MLT_{EOD}$ of the Lv.4 road links are output to the image processing section 125. The image processing section 125 outputs the input ease-of-driving levels $MLT_{EOD}$ to the display section 116 along with the map data to display the ease-of-driving levels $MLT_{EOD}$ as replacements for the ease-of-driving scores $LT_{EOD}$ from environment information. The replacement display of the ease-of-driving levels $MLT_{EOD}$ is performed when the size of the unit areas to be displayed is enlarged, i.e. the size of the areas on the map data corresponding to the road links after changing the road links from a lower level to a higher level. The size of the unit areas is enlarged to expand the scale of the map data displayed on the display section 116, for example.

A specific procedure of a calculation process of the ease-of-driving levels from environment information executed by the management center 200 will be described as an example of action of the present embodiment.

As shown in FIG. 10, the management center 200 acquires the road link IDs corresponding to the position information of various vehicles, which are acquisition sources of the environment information, through the data reception management section 202 and refers to the map data registered in the map database 220 based on the acquired road link IDs to identify the road structure factors for each of the Lv.2 road links (step S10). The management center 200 calculates the static ease-of-driving scores $S_{EOD}$ through the ease-of-driving score calculation section 207 with reference to the index table 230 based on the identified road structure factors.

Subsequently, the management center 200 acquires the image data registered in the road image database 210 and analyzes the acquired image data through the environment recognition section 206 to identify the road environment, the traffic conditions, and the weather conditions for each of the Lv.2 road links. The management center 200 also acquires the road traffic information and the weather information from Japan Road Traffic Information Center through the data reception management section 202 and analyzes the acquired road traffic information and weather information through the environment recognition section 206 to identify the road environment, the traffic conditions, and the weather conditions for each of the Lv.2 road links. The management center 200 calculates the indices of the items prescribed in the identified road environment, traffic conditions, and weather conditions through the ease-of-driving score calculation section 207 with reference to the index table 230. The management center 200 calculates the sum of the calculated indices, which serves as the dynamic ease-of-driving score $D_{EOD}$ (step S11).

Subsequently, the management center 200 subtracts the dynamic ease-of-driving scores $D_{EOD}$ calculated in step S11 from the static ease-of-driving scores $S_{EOD}$ calculated in step S10 to calculate the ease-of-driving scores $T_{EOD}$ from environment information through the ease-of-driving score calculation section 207 (step S12).

The management center 200 ranks the calculated ease-of-driving scores $T_{EOD}$ into a plurality of classes to calculate the ease-of-driving levels $LT_{EOD}$ from environment information through the ease-of-driving level calculation section 205 (step S13).

A specific procedure of an uploading process from the vehicle 100 to the management center 200 will be described as an example of action of the present embodiment.

Figure 11:
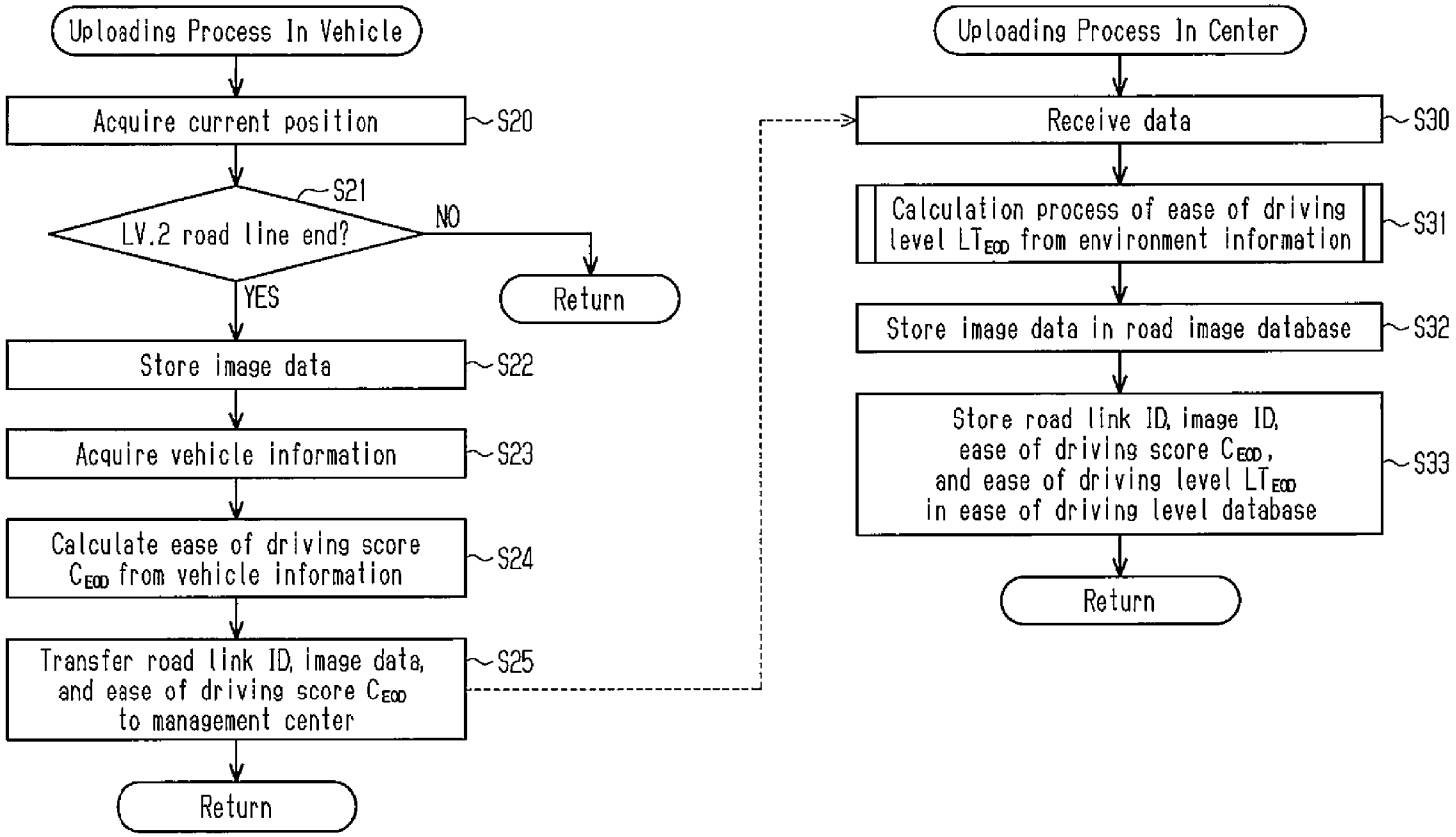
FIG. 11 is a flowchart showing an example of an uploading process from the vehicle to a management center.

As shown in FIG. 11, the vehicle 100 acquires the information of the vehicle position from moment to moment through the current position acquisition section 112 (step S20). If the acquired vehicle position is not the link end of a Lv.2 road link, i.e. if the vehicle 100 has not reached a node included in a road of a lower road level (step S21=NO), the vehicle 100 stands by until the vehicle 100 reaches the link end of a Lv.2 road link while acquiring the information of the vehicle position from moment to moment. On the other hand, if the acquired vehicle position is the link end of a Lv.2 road link (step S21=YES), the vehicle 100 stores the image data around the vehicle acquired at this point through the image acquisition section 120 in the memory area 121 in association with the road link ID corresponding to the vehicle position (step S22).

The vehicle 100 then acquires the vehicle information through the vehicle information acquisition section 123 (step S23) and substitutes the acquired vehicle information into the regression equation to calculate the ease-of-driving score $C_{EOD}$ from vehicle information through the vehicle information processing section 124 (step S24). The vehicle 100 stores the calculated ease-of-driving score $C_{EOD}$ from vehicle information in the memory area 121 in association with the road link ID corresponding to the vehicle position.

Periodically or in response to a request from the management center 200, the vehicle 100 transfers the image data and the ease-of-driving score $C_{EOD}$ stored in the memory area 121 to the management center 200 through the vehicle communication I/F 122 in association with the road link ID corresponding to the vehicle position at the time of the acquisition of the image data and the ease-of-driving score $C_{EOD}$ (step S25).

Meanwhile, the management center 200 is in a state of standing by for data reception from the vehicle 100. When the management center 200 receives image data from the vehicle 100 through the center communication I/F 201 (step S30), the management center 200 uses the received image data to execute the calculation process of the ease-of-driving level from environment information shown in FIG. 10 (step S31).

The management center 200 then stores the image data received from the vehicle 100 in step S30 in the road image database 210 through the image management section 204 along with the road link ID associated with the image data (step S32).

The management center 200 stores the ease-of-driving score $C_{EOD}$ from vehicle information received from the vehicle 100 in step S30 in the ease-of-driving level database 240 through the ease-of-driving level management section 208 along with the road link ID associated with the ease-of-driving score $C_{EOD}$ (step S33). The management center 200 also stores the ease-of-driving level $LT_{EOD}$ from environment information calculated in step S31 in the ease-of-driving level database 240 through the ease-of-driving level management section 208 along with the road link ID and the image ID associated with the ease-of-driving level $LT_{EOD}$ (step S33).

A specific procedure of a downloading process from the management center 200 to the vehicle 100 will be described as an example of action of the present embodiment.

Figure 12:
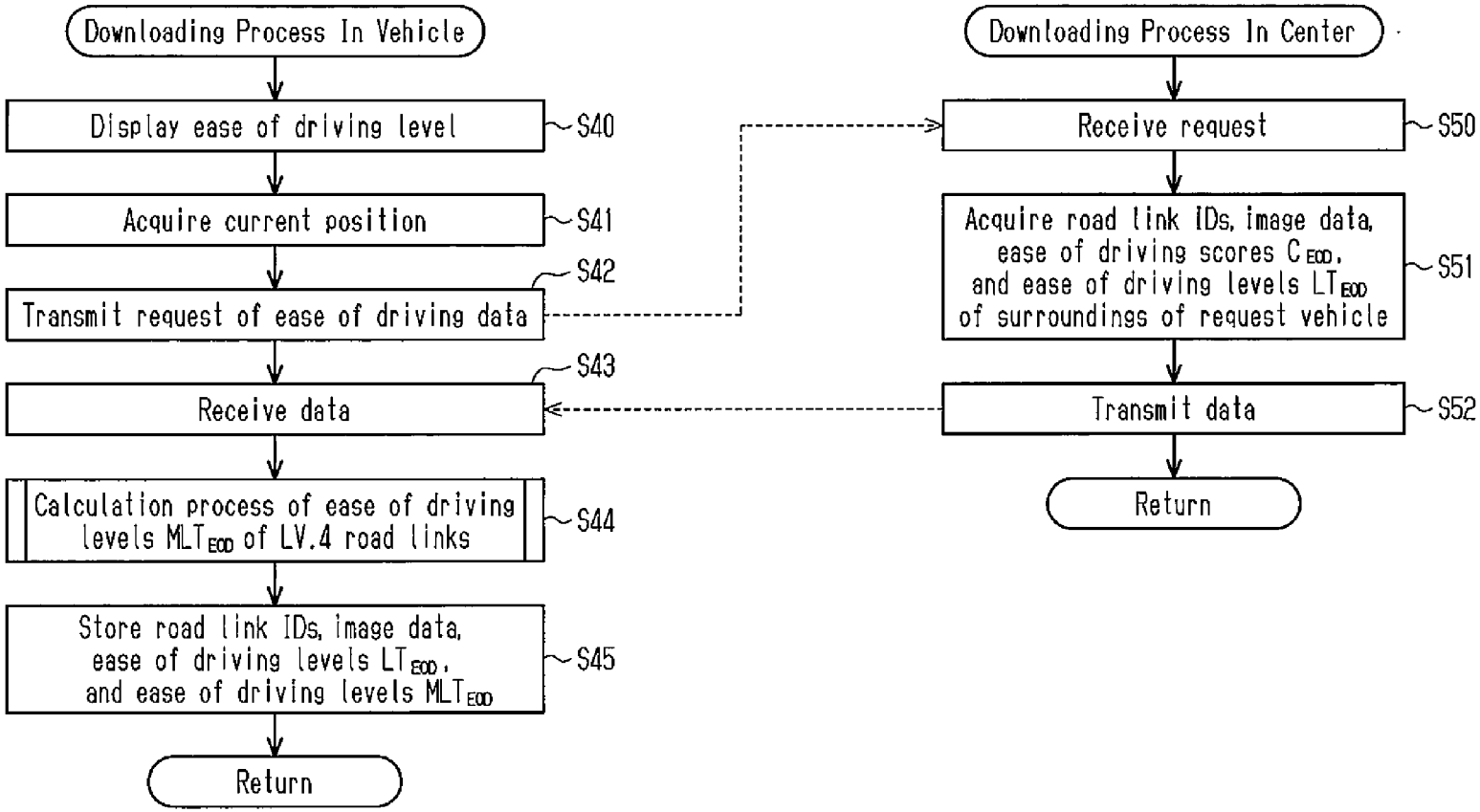
FIG. 12 is a flowchart showing an example of a downloading process from the management center to the vehicle.

As shown in FIG. 12, the vehicle 100 reads the ease-of-driving level $LT_{EOD}$ from environment information distributed at this point from the management center 200 and stored in the memory area 121 and outputs and displays the read ease-of-driving level $LT_{EOD}$ to the display section 116 through the image processing section 125 (step S40). When the scale of the map data displayed on the display section 116 is expanded, the vehicle 100 outputs and displays the ease-of-driving levels $MLT_{EOD}$ of the Lv.4 road links stored in the memory area 121 on the display section 116 through the image processing section 125 in place of the ease-of-driving levels $LT_{EOD}$ from environment information (step S40).

The vehicle 100 then acquires the information of the vehicle position from moment to moment through the current position acquisition section 112 (step S41) and determines the road link ID with reference to the map database 115 based on the acquired information related to the vehicle position. The vehicle 100 transmits the determined road link ID to the management center 200 through the vehicle communication I/F 122 along with a request command for the ease-of-driving data (step S42).

The management center 200 is in a state of standing by for the request command for the ease-of-driving data from the vehicle 100. When the management center 200 receives the request command from the vehicle 100 through the center communication I/F 201 (step S50), the management center 200 determines the current position of the vehicle on the map data through the ease-of-driving level management section 208 with reference to the map database 220 based on the road link ID received along with the request command. The management center 200 extracts the road link IDs corresponding to the surroundings of the determined current position from the ease-of-driving level database 240 through the ease-of-driving level management section 208. The management center 200 reads the ease-of-driving levels $LT_{EOD}$ from environment information and the ease-of-driving scores $C_{EOD}$ from vehicle information associated with the extracted road link IDs from the data managed in the ease-of-driving level database 240 through the ease-of-driving level management section 208 (step S51). The management center 200 transmits the read data to the vehicle 100 through the center communication I/F 201 (step S52).

The management center 200 determines the current position of the vehicle on the map data through the image management section 204 with reference to the map database 220 based on the road link ID received along with the request command from the vehicle 100. The management center 200 extracts the road link IDs corresponding to the surroundings of the determined current position from the road image database 210 through the image management section 204. The management center 200 reads the image data associated with the extracted road link IDs from the image data managed in the road image database 210 (step S51) and distributes the read data to the vehicle 100 through the center communication I/F 201 (step S52).

When the data is distributed from the management center 200, the vehicle 100 receives the data (step S43) and uses the data to execute the calculation process of the ease-of-driving levels $MLT_{EOD}$ of the Lv.4 road links through the ease-of-driving level processing section 126 (step S44). In addition to the calculated ease-of-driving levels $MLT_{EOD}$ of the Lv.4 road links, the vehicle 100 stores the image data distributed from the management center 200 and the ease-of-driving levels $LT_{EOD}$ from environment information in the memory area 121 in association with the road link IDs (step S45).

A specific procedure of a calculation process of the ease-of-driving levels of the Lv.4 road links executed by the vehicle 100 will be described as an example of action of the present embodiment.

Figure 13:
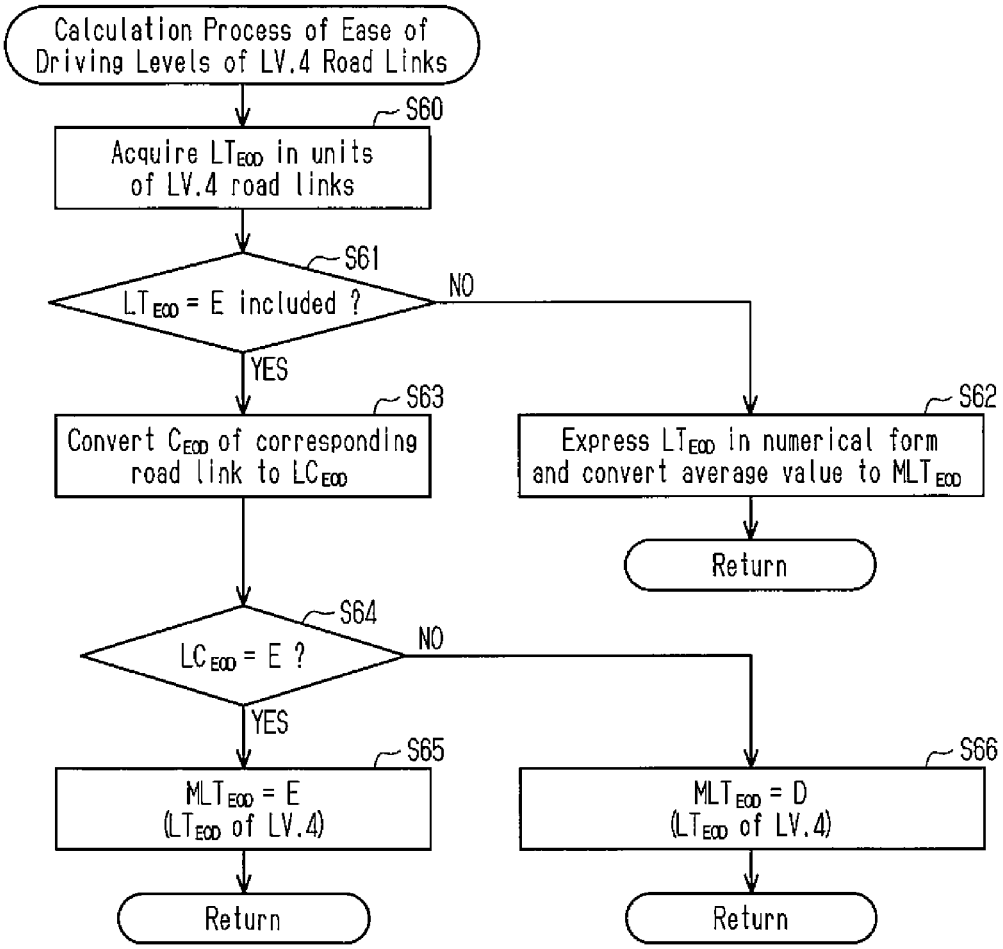
FIG. 13 is a flowchart showing an example of an ease-of-driving level calculation process for each Lv.4 road link.

As shown in FIG. 13, the vehicle 100 acquires, in units of Lv.4 road links, the ease-of-driving levels $LT_{EOD}$ from environment information, which are stored in units of Lv.2 road links in the memory area 121 (step S60). The ease-of-driving levels $LT_{EOD}$ acquired in units of Lv.4 road links include a plurality of ease-of-driving levels $LT_{EOD}$ stored in units of Lv.2 road links.

Figure 14:
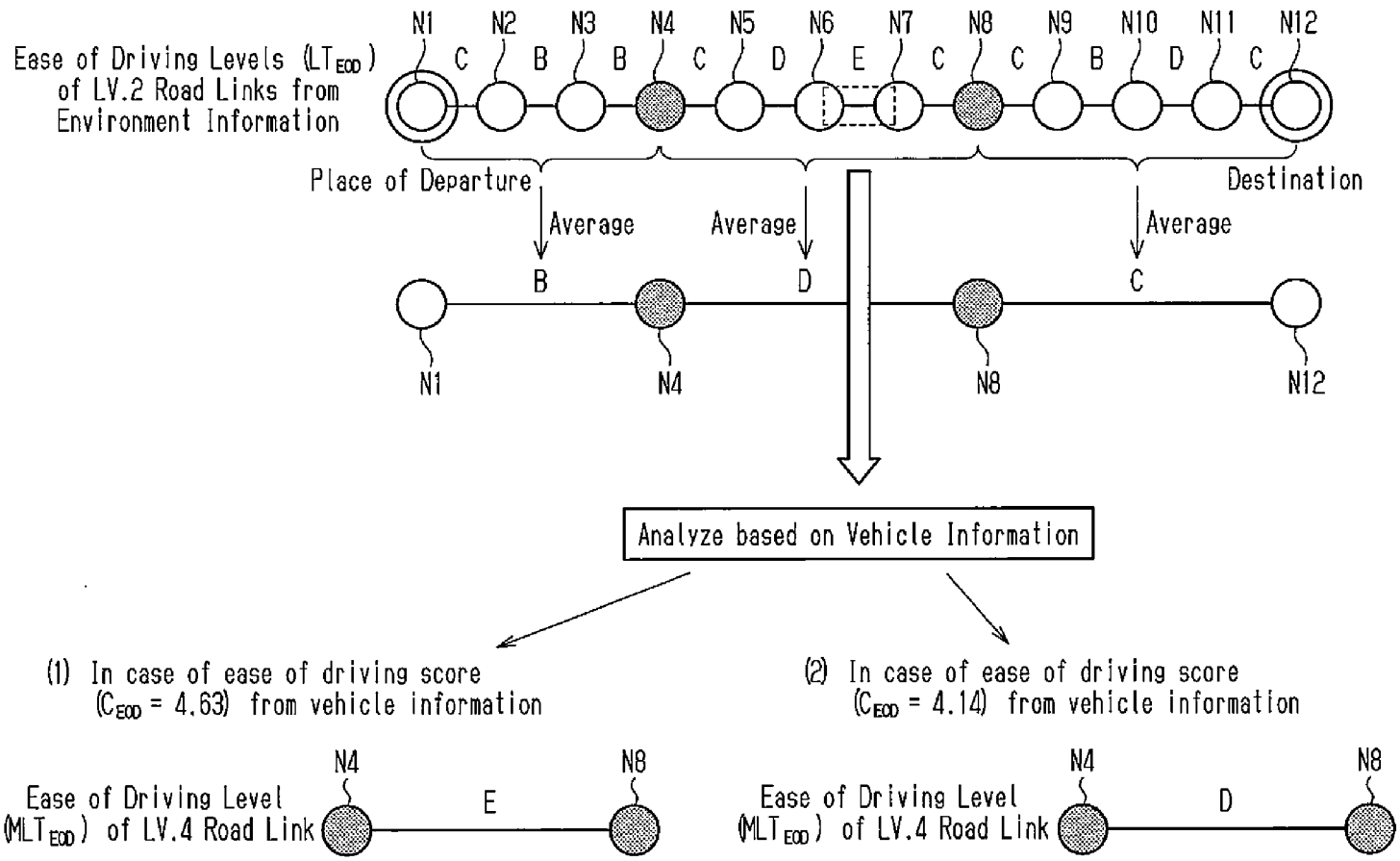
FIG. 14 is an explanatory diagram showing a calculation procedure of the ease-of-driving level for each Lv.4 road link.

In an example shown in FIG. 14, twelve nodes N1 to N12 are included between the place of departure to the destination on a searched optimal route, and two nodes N4 and N8 indicated by dotted hatching among the nodes on the optimal route are the link ends of Lv.4 road links. The other nodes on the optimal route are the link ends of Lv.2 road links. The road link between the link ends of the adjacent Lv.4 road links is an Lv.4 road link. The road link between the link end of the Lv.2 road link corresponding to the place of departure and the link end of the Lv.4 road link as well as the link end of the Lv.2 road link corresponding to the destination and the link end of the Lv.4 road link are Lv.4 road links. On the other hand, the road links between the link ends of adjacent Lv.2 road links as well as the road links between the link ends of adjacent Lv.2 road links and the link ends of the Lv.4 road links are Lv.2 road links. In the present embodiment, a first road link between the node N1 corresponding to the place of departure and the node N4, which is one of the link ends of the Lv.4 road link is a Lv.4 road link. A second road link between both nodes N4 and N8, which are the link ends of the Lv.4 road link, is also an Lv.4 road link. A third road link between the other node N8, which is the link end of the Lv.4 road link, and the node N12 corresponding to the destination is also an Lv.4 road link. The other road links are Lv.2 road links.

As shown in FIG. 13, the vehicle 100 determines whether the ease-of-driving levels $LT_{EOD}$ acquired in units of Lv.4 road links in step S60 include an Lv.2 road link of level E (step S61). If the Lv.2 road link of level E is not included (step S61=NO), the vehicle 100 expresses all the ease-of-driving levels $LT_{EOD}$ of Lv.2 road links included in the Lv.4 road links in a numerical form. The vehicle 100 converts the average values through the ease-of-driving level processing section 126, the average values serving as the ease-of-driving levels $MLT_{EOD}$ of Lv.4 road links (step S62).

In the example shown in FIG. 14, the first road link and the third road link acquired in units of Lv.4 road links do not include Lv.2 road links of level E. Therefore, for the first road link, the vehicle 100 expresses C, B, and B, which indicate the ease-of-driving levels $LT_{EOD}$ of three Lv.2 road links that are constituent elements of the first road link, in a numerical form "3", "2", and "2", for example. The vehicle 100 converts "2," which is an average value of the numbers (decimal places are truncated), into B as the ease-of-driving level $MLT_{EOD}$ of Lv.4 road link.

On the other hand, as shown in FIG. 13, if the ease-of-driving levels $LT_{EOD}$ acquired in units of Lv.4 road links in step S60 include a Lv.2 road link of level E (step S61=YES), the vehicle 100 reads the ease-of-driving score $C_{EOD}$ from vehicle information corresponding to the Lv.2 road link from the memory area 121. The vehicle 100 ranks the read ease-of-driving score $C_{EOD}$ into five classes to convert the score through the ease-of-driving level processing section 126, the score serving as the ease-of-driving level $LC_{EOD}$ from vehicle information (step S63).

In the example shown in FIG. 14, the second road links acquired in units of Lv.4 road links include one Lv.2 road link of level E. Therefore, for the second road link, the vehicle 100 reads, from the memory area 121, the corresponding ease-of-driving score $C_{EOD}$ from vehicle information for the Lv.2 road link of level E surrounded by dashed lines among the four Lv.2 road links that are the constituent elements. As in an example indicated by (1) in FIG. 14, when the ease-of-driving score $C_{EOD}$ of the Lv.2 road link is 4.63, the vehicle 100 ranks the ease-of-driving score $C_{EOD}$ into E to convert the ease-of-driving score $C_{EOD}$ into the ease-of-driving level $LC_{EOD}$. In contrast, as in an example indicated by (2) in FIG. 14, when the ease-of-driving score $C_{EOD}$ of the Lv.2 road link is 4.14, the vehicle 100 ranks the ease-of-driving score $C_{EOD}$ into D to convert the ease-of-driving score $C_{EOD}$ into the ease-of-driving level $LC_{EOD}$.

As shown in FIG. 13, if the ease-of-driving level $LC_{EOD}$ converted in step S63 is E (step S64=YES, example indicated by (1) in FIG. 14), the vehicle 100 sets the ease-of-driving level $MLT_{EOD}$ of Lv.4 road link including the Lv.2 road link to E through the ease-of-driving level processing section 126 (step S65). More specifically, the vehicle 100 sets the ease-of-driving level $MLT_{EOD}$ of Lv.4 road link to level E, which is displaced from the median, on the condition that the Lv.4 road link includes a Lv.2 road link in which both of the ease-of-driving level $LT_{EOD}$ from environment information and the ease-of-driving level $LC_{EOD}$ from vehicle information are in level E, which is displaced from the median of the classified levels. This means that the Lv.2 road link tends to be really hard to drive when the level is E, from the viewpoint of not only the ease-of-driving level $LT_{EOD}$ from environment information, but also the ease-of-driving level $LC_{EOD}$ from vehicle information. Therefore, the ease-of-driving level $MLT_{EOD}$ of Lv.4 road link needs to be calculated by sufficiently taking into account the influence of the Lv.2 road links.

On the other hand, if the ease-of-driving level $LC_{EOD}$ converted in step S63 is not E (step S64=NO, example indicated by (2) in FIG. 14), the vehicle 100 sets the ease-of-driving level $MLT_{EOD}$ of Lv.4 road link including the Lv.2 road link to D through the ease-of-driving level processing section 126 (step S66).

Operation of the traveling environment evaluation system of the present embodiment will now be described. Particularly, an example of displaying the ease-of-driving levels of the areas corresponding to the Lv.4 road links as a result of expansion of the display scale of the road links will be described.

In general, when the ease-of-driving level of the vehicle in a road link in a higher level is simply calculated by averaging the ease-of-driving levels of the vehicle based on external elements, such as a road environment, traffic conditions, and weather conditions, of the Lv.2 road links that are constituent elements of the Lv.4 road link regardless of the traveling state of the vehicle from moment to moment, the calculated level tends to be biased toward the median of a plurality of classified levels. Therefore, if the subject Lv.4 road link includes an Lv.2 road link of a level displaced from the median, the Lv.2 road link, which particularly leaves an impression on the occupant of the vehicle, may not be sufficiently taken into account in the ease-of-driving level of the vehicle obtained by averaging. As a result, the occupant of the vehicle actually in the traveling state may feel uncomfortable.

In the present embodiment, if a Lv.2 road link of a level displaced from the median is included when the display scale of the road links to be displayed is expanded, the Lv.2 road link is examined based on parameters indicating the traveling state of the vehicle, and the ease-of-driving level obtained by the examination is displayed as a replacement. More specifically, if an Lv.2 road link of a level displaced from the median is partially included, the ease-of-driving level of the vehicle in the Lv.4 road link is examined based on the vehicle information. The examination of the ease of driving of the vehicle based on the vehicle information is performed based on an evaluation value of the traveling environment based on the vehicle information, i.e. an evaluation value of the traveling environment felt by the occupant of the vehicle as a result of the actual traveling of the vehicle in the past. Therefore, by displaying, as a replacement, the level obtained by the examination based on the vehicle information as an ease-of-driving level in the Lv.4 road link, the Lv.2 road link is sufficiently taken into account if the Lv.4 road link includes the Lv.2 road link that easily leaves an impression on the occupant of the vehicle. As a result, the occupant of the vehicle actually in the traveling state can easily sense this, and discrepancy between a sensible value of the occupant of the vehicle and a display value can be prevented.

As described above, the first embodiment has the following advantages.

(1) For the Lv.4 road link including the Lv.2 road link displaced from the median of the classified levels of ease of driving when the road links to be displayed are changed from the Lv.2 road links to the Lv.4 road links, the ease-of-driving level $MLT_{EOD}$ of Lv.4 road link calculated based on the ease-of-driving score $C_{EOD}$ from vehicle information for the Lv.2 road link of the level displaced from the median is displayed as a replacement. The occupant of the vehicle actually in the traveling state can easily sense the obtained level displayed as a replacement for the ease-of-driving level $MLT_{EOD}$ of Lv.4 road link, and the discrepancy between the sensible value of the occupant of the vehicle and the display value is prevented. Therefore, even when the scale of the road links to be displayed is changed, the evaluation of the ease of driving of the vehicle in each road link can be displayed without giving an uncomfortable feeling to the occupant of the vehicle.

(2) In the calculation of the ease-of-driving level $MLT_{EOD}$ of Lv.4 road link based on the ease-of-driving score $C_{EOD}$ from vehicle information, the level is set as a level to be displayed as a replacement on the display section 116 on the condition that the ease-of-driving level $LC_{EOD}$ obtained by classifying the ease-of-driving score $C_{EOD}$ into a plurality of classes is displaced from the median. More specifically, the level displaced from the median is displayed as a replacement for the ease-of-driving level $MLT_{EOD}$ of Lv.4 road link on the condition that the Lv.4 road link includes the Lv.2 road link in which both of the ease-of-driving level $LT_{EOD}$ of the vehicle based on the environment information related to at least one of the elements including the road environment, the traffic conditions, and the weather conditions and the ease-of-driving level $LT_{EOD}$ of the vehicle based on the parameters indicating the traveling state of the vehicle are displaced from the median of the classified levels. Therefore, the ease-of-driving level closer to the feeling of the occupant of the vehicle can be displayed.

(3) For the Lv.4 road link not including a Lv.2 road link of the level displaced from the median when the road links to be displayed are changed from the Lv.2 road links to the Lv.4 road links, the average value of the ease-of-driving levels $LT_{EOD}$ from environment information in the Lv.2 road links included in the Lv.4 road link is displayed as the ease-of-driving level $MLT_{EOD}$ of Lv.4 road link. More specifically, if the Lv.2 road links included in the Lv.4 road link do not include an Lv.2 road link in which the ease-of-driving level $LT_{EOD}$ of the vehicle based on the environment information related to at least one of the elements including the road environment, the traffic conditions, and the weather conditions is displaced from the median, the levels of the Lv.2 road links have values closer to the median from the beginning. Therefore, even if the ease-of-driving level $MLT_{EOD}$ of Lv.4 road link is calculated by averaging, the discrepancy between the calculated level and the sensible value of the occupant of the vehicle can be prevented.

(4) The road links to be displayed are changed along with the expansion of the scale of the road map. Therefore, when the road links to be displayed are changed along with the expansion of the scale of the road map, the levels of the ease of driving of the vehicle in the road links can be displayed without giving an uncomfortable feeling to the occupant of the vehicle.

(5) The level E, at which the ease-of-driving level of the vehicle is lower than a predetermined value, is used as the level displaced from the median. More specifically, if the evaluation of the area that tends to be hard to drive is diverged from the actual circumstances as a result of averaging, the occupant of the vehicle may have a strong uncomfortable feeling that the part is hard to drive when the vehicle actually travels the part. Therefore, the discrepancy between the sensible value of the occupant of the vehicle and the display value can be prevented for the evaluation of the area that tends to be hard to drive, i.e. for the display of the ease-of-driving level of the Lv.4 road link including the Lv.2 road link in which the ease-of-driving level of the vehicle is in the level E lower than the predetermined value. This favorably reduces the uncomfortable feeling of the occupant of the vehicle.

(6) Parameters collected from a plurality of onboard control devices by communication prescribed in a CAN protocol are used as parameters indicating the traveling states of the vehicles. Therefore, the highly versatile CAN protocol, which is often used in the vehicles, can be used to collect the parameters indicating the traveling states of a wide variety of vehicles. As a result, the ease-of-driving levels of the vehicles in the road links can be displayed in a manner that the uncomfortable feeling of the occupant of the vehicle is further reduced.

(7) In the calculation of the ease-of-driving score $T_{EOD}$ from environment information, the road structure factor to be evaluated is numerically evaluated to calculate the base score based on the road map data, in which information related to the road map is registered. The factor in drop of the ease of driving of the vehicle is expressed in a numerical form based on the analysis of the environment information related to at least one of the elements including the road environment, the traffic conditions, and the weather conditions. The factor in drop of the ease of driving of the vehicle expressed in a numerical form is subtracted from the base score to calculate the ease-of-driving score numerically evaluating the ease of driving of the vehicle. Therefore, the static and dynamic elements can be taken into account to evaluate the ease-of-driving level $LT_{EOD}$ of the vehicle from environment information according to the actual circumstances.

(8) The traveling environment evaluation system includes the management center 200, which manages the traveling information of a plurality of subject vehicles through wireless communication. The vehicle 100 evaluates the ease-of-driving score $C_{EOD}$ of the vehicle from vehicle information for each road link and transfers the ease-of-driving score $C_{EOD}$ to the management center 200. The vehicle 100 displays, as a replacement and on the display section 116, the ease-of-driving level $MLT_{EOD}$ of each Lv.4 road link calculated based on the ease-of-driving score $C_{EOD}$ from vehicle information distributed from the management center 200. Since the vehicle 100 computes the ease-of-driving score $C_{EOD}$ from vehicle information, the vehicle information does not have to be transferred from the vehicle 100 to the management center 200, and the communication load between the vehicle 100 and the management center 200 can be reduced. Since the management center 200 integrates the ease-of-driving scores $C_{EOD}$ from vehicle information received from the plurality of vehicles 100, the map range in which the ease-of-driving scores $C_{EOD}$ can be obtained is enlarged, and the versatility of the map is increased.

(9) The traveling environment evaluation system includes the management center 200, which manages the traveling information of a plurality of subject vehicles by wireless communication. The vehicles 100 transfer the image data acquired during traveling to the management center 200, and the management center 200 integrates and uses the image data received from the plurality of vehicles 100 to calculate the ease-of-driving levels $LT_{EOD}$ from environment information. Therefore, the map range in which the ease-of-driving levels $LT_{EOD}$ can be obtained is enlarged, and the versatility of the map is increased. The management center 200 distributes the image data according to the traveling positions of the vehicles 100 to each vehicle 100. In this case, since the management center 200 integrates the image data received from the plurality of vehicles 100, the map range in which the image data can be obtained is enlarged, and the versatility of the map is increased.

Second Embodiment

A traveling environment evaluation system according to a second embodiment will be described with reference to the drawings. The second embodiment is different from the first embodiment in that the management center calculates the ease-of-driving score from vehicle information. Therefore, in the explanation below, configurations different from the first embodiment will be mainly described, and the description of the same or equivalent configurations as in the first embodiment will not be repeated.

Figure 15:
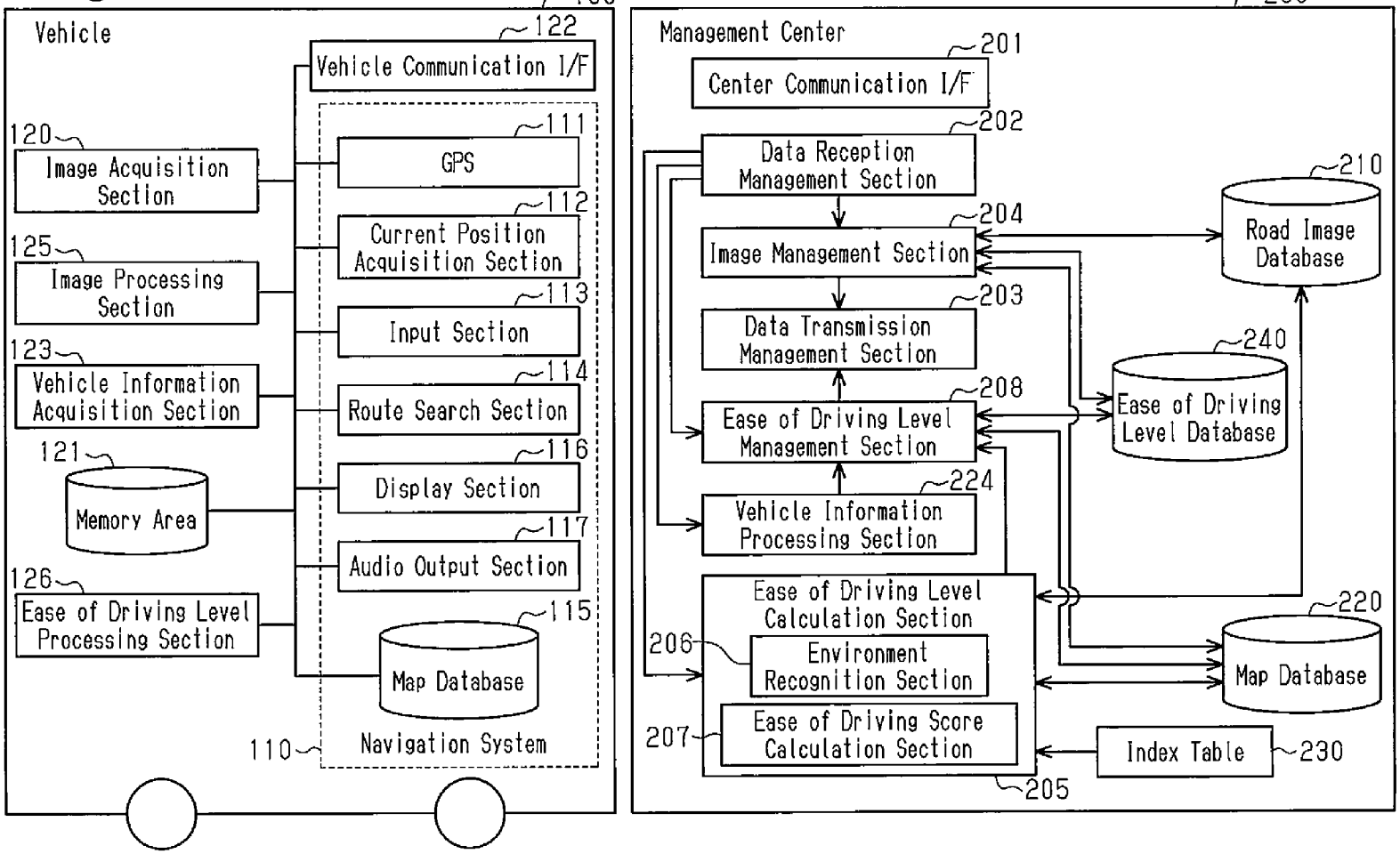
FIG. 15 is a block diagram showing a schematic configuration of a traveling environment evaluation system according to a second embodiment.

As shown in FIG. 15, when the vehicle 100 acquires the vehicle information through the vehicle information acquisition section 123 in the present embodiment, the vehicle 100 determines the road link ID with reference to the map database 115 based on the information related to the vehicle position acquired through the current position acquisition section 112 at this point. The vehicle 100 transfers the vehicle information to the management center 200 through the vehicle communication I/F 122 in association with the determined road link ID.

Meanwhile, when the data reception management section 202 of the management center 200 receives the vehicle information through the center communication I/F 201, the data reception management section 202 outputs the received vehicle information to a vehicle information processing section 224. The vehicle information processing section 224 calculates the ease-of-driving score $C_{EOD}$ from vehicle information based on the input vehicle information. The vehicle information processing section 224 outputs the calculated ease-of-driving score $C_{EOD}$ to the ease-of-driving level management section 208. When the ease-of-driving score $C_{EOD}$ is input from the vehicle information processing section 224, the ease-of-driving level management section 208 stores the ease-of-driving score $C_{EOD}$ in the ease-of-driving level database 240 in association with the corresponding road link ID.

In addition to the advantage (8) of the first embodiment, the second embodiment achieves the following advantage.

(8A) The traveling environment evaluation system includes the management center 200, which manages the traveling information of a plurality of subject vehicles through wireless communication. The management center 200 calculates the ease-of-driving score $C_{EOD}$ from vehicle information for each road link based on the vehicle information received from the plurality of vehicles and distributes the calculated ease-of-driving scores $C_{EOD}$ to each vehicle 100. The vehicle 100 displays, as a replacement and on the display section 116, the ease-of-driving levels $MLT_{EOD}$ of the Lv.4 road links calculated based on the ease-of-driving scores $C_{EOD}$ from vehicle information distributed from the management center 200. Specifically, since the management center 200 computes the ease-of-driving scores $C_{EOD}$ from vehicle information, the processing load in the vehicle 100 can be reduced. Since the management center 200 integrates the ease-of-driving scores $C_{EOD}$ from vehicle information received from the plurality of vehicles 100, the map range in which the ease-of-driving scores $C_{EOD}$ can be obtained is enlarged, and the versatility of the map is increased.

Third Embodiment

A traveling environment evaluation system according to a third embodiment will be described with reference to the drawings. The third embodiment is different from the first embodiment in that the vehicle calculates the ease-of-driving level from environment information. Therefore, in the explanation below, configurations different from the first embodiment will be mainly described, and the description of the same or equivalent configurations as in the first embodiment will not be repeated.

Figure 16:
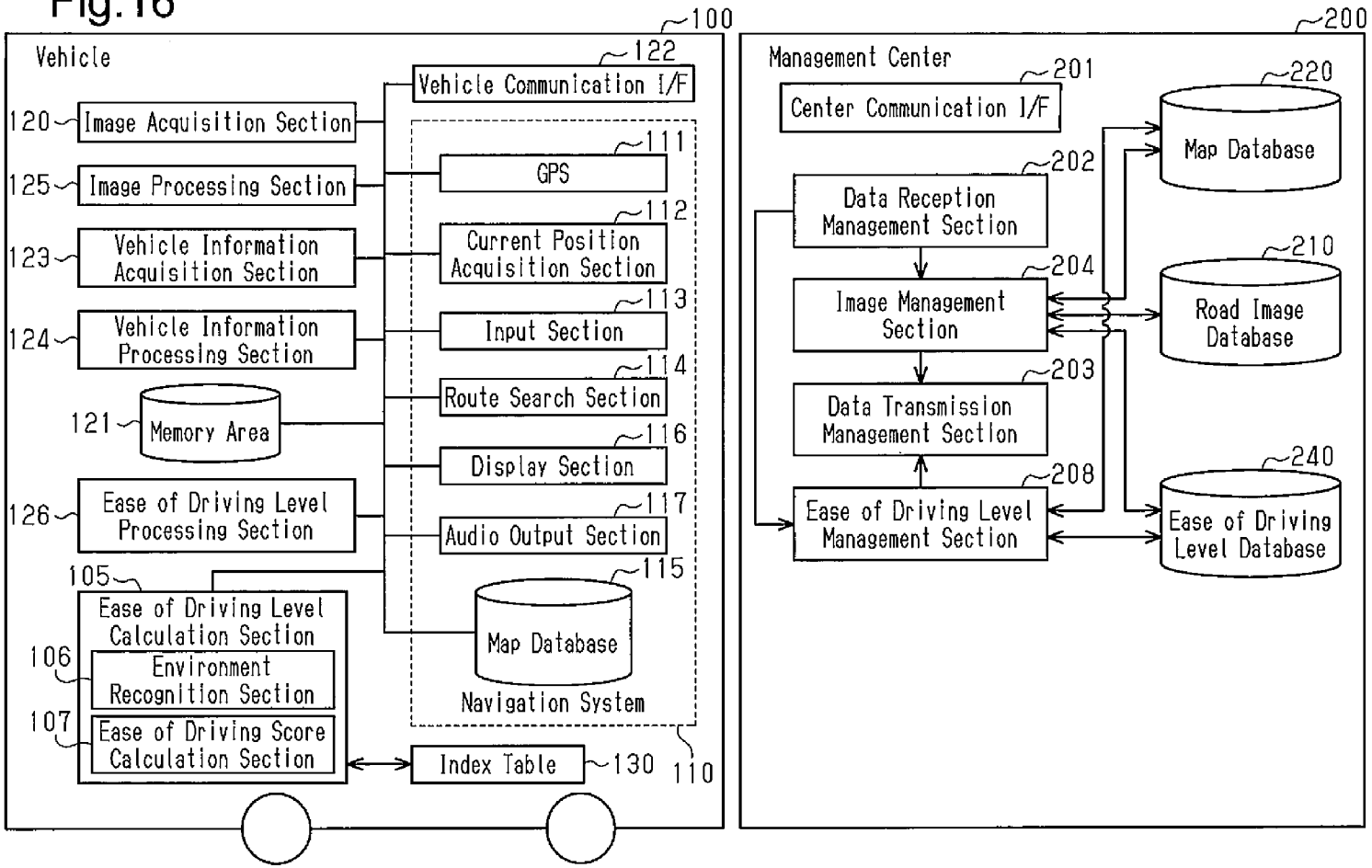
FIG. 16 is a block diagram showing a schematic configuration of a traveling environment evaluation system according to a third embodiment.

As shown in FIG. 16, the vehicle 100 communicates not only with the center communication I/F 201 through the vehicle communication I/F 122, but also with, for example, Japan Road Traffic Information Center, which manages road traffic information related to congestion, construction, accidents, and the like as well as weather information related to the weather of each area, earthquake warning, and the like in the present embodiment. The vehicle 100 stores the image data distributed from the management center 200 in the memory area 121. An ease-of-driving level calculation section 105 of the vehicle 100 analyzes, through an environment recognition section 106, the image data stored in the memory area 121 as well as the road traffic information and the weather information received from Japan Road Traffic Information Center through the vehicle communication I/F 122. The management center 200 uses the analysis result to calculate the ease-of-driving score $T_{EOD}$ from environment information with reference to an index table 130 through an ease-of-driving score calculation section 107. The ease-of-driving level calculation section 105 converts the calculated ease-of-driving level $T_{EOD}$ into the ease-of-driving level $LT_{EOD}$ and transfers the ease-of-driving level $LT_{EOD}$ to the management center 200 through the vehicle communication I/F 122 in association with the corresponding road link ID.

When the management center 200 receives the ease-of-driving level $LT_{EOD}$ associated with the road link ID from the vehicle 100 through the center communication I/F 201, the management center 200 outputs the received ease-of-driving level $LT_{EOD}$ to the ease-of-driving level management section 208 from the data reception management section 202. When the ease-of-driving level $LT_{EOD}$ is input from the data reception management section 202, the ease-of-driving level management section 208 stores the ease-of-driving level $LT_{EOD}$ in the ease-of-driving level database 240 in association with the road link ID.

In addition to the advantages (1) to (8) of the first embodiment, the third embodiment achieves the following advantage.

(10) The traveling environment evaluation system includes the management center 200, which manages the traveling information of a plurality of subject vehicles through wireless communication. The vehicle 100 calculates the ease-of-driving levels $LT_{EOD}$ from environment information for the road links based on the environment information acquired through the vehicle communication I/F 122 and transfers the calculated ease-of-driving levels $LT_{EOD}$ to the management center 200. The vehicle 100 calculates the ease-of-driving levels $MLT_{EOD}$ of the Lv.4 road links based on the ease-of-driving scores $C_{EOD}$ from vehicle information with reference to the ease-of-driving scores $LT_{EOD}$ from environment information distributed from the management center 200. Specifically, since the vehicle 100 computes the ease-of-driving scores $LT_{EOD}$ from environment information, the processing load in the management center 200 can be reduced. Since the management center 200 integrates the ease-of-driving levels $LT_{EOD}$ from environment information received from the plurality of vehicles 100, the map range in which the ease-of-driving levels $LT_{EOD}$ can be obtained is enlarged, and the versatility of the map is increased.

Other Embodiments

The above described embodiments may be modified as follows.

In the above illustrated embodiments, the static ease-of-driving score $S_{EOD}$ is calculated based on the road structure factors, and the dynamic ease-of-driving score $D_{EOD}$ is subtracted from the static ease-of-driving score $S_{EOD}$ to calculate the ease-of-driving score $T_{EOD}$ from environment information. In place of the subtraction system, a point-addition system may be adopted, for example. According to this, indices may be calculated for items designated in the road structure factors, the road environment, the traffic conditions, and the weather conditions, and a total value or an average value of the calculated indices may be calculated as the ease-of-driving score $T_{EOD}$, for example.

In the above illustrated embodiments, the collection route of the parameters related to the traveling state of the vehicle is CAN. The collection route is not limited to this, and a communication bus of another communication standard, such as Ethernet (registered trademark), FlexRay (registered trademark), and Lin (Local interconnect network), may be used as the collection route of the parameters.

In the above illustrated embodiments, the ease-of-driving level $MLT_{EOD}$ of Lv4 road link including the Lv.2 road link is set to D if the ease-of-driving level $LC_{EOD}$ converted from the ease-of-driving level $C_{EOD}$ from vehicle information is not E. Alternatively, the ease-of-driving level $LC_{EOD}$ converted from the ease-of-driving level $C_{EOD}$ from vehicle information may be set as the ease-of-driving level $MLT_{EOD}$ of Lv.4 road link including the corresponding Lv.2 road link.

In the above illustrated embodiments, the elements of the environment information include the road environment, the traffic conditions, and the weather conditions. However, not limited to this, it is only necessary that the environment information includes at least one of the elements including the road environment, the traffic conditions, and the weather conditions.

In the above illustrated embodiments, the level E in which the ease-of-driving level of the vehicle is lower than the predetermined value is used as the level displaced from the median. Alternatively, this, level A in which the ease-of-driving level of the vehicle is equal to or higher than a predetermined value may be used as the level displaced from the median, for example.

In the above illustrated embodiments, the ease-of-driving levels $MLT_{EOD}$ of the Lv.4 road links are calculated when the road links are changed from the Lv.2 road links to the Lv.4 road links along with the expansion of the scale of the map data displayed on the display section 116. Alternatively, the ease-of-driving levels $MLT_{EOD}$ of the Lv.4 road links may also be calculated regardless of the scale of the map data, when the road links are changed from the Lv.2 road links to the Lv.4 road links by manual operation of the occupant of the vehicle, for example.

In the above illustrated embodiments, the ease of driving at locations around the vehicle 100 provided with the navigation system 110 is evaluated. Alternatively, the ease of driving related to routes searched by the navigation system 110 may be evaluated.

In the above illustrated embodiments, the image data, the road traffic information, and the weather information are analyzed to acquire the environment information. Alternatively, the environment information may be acquired through a millimeter wave radar, a wiper sensor, a spectrum sensor, infrastructure communication, inter-vehicle communication, or the like.

In the above illustrated embodiments, the vehicle 100 or the management center 200 acquires the environment information. Alternatively, an information terminal, such as a multifunctional telephone, may acquire the environment information.

In the above illustrated embodiments, the ease-of-driving score is calculated for each road link. Alternatively, the ease-of-driving score may be calculated for each prescribed traveling distance.

In the above illustrated embodiments, the ease-of-driving level is converted in five classes of A, B, C, D, and E. Alternatively, the ease-of-driving level may be converted in four or fewer classes or in six or more classes.

The invention claimed is:

1. A traveling environment evaluation system comprising:

a first traveling environment evaluation section configured to calculate an evaluation value of a first traveling environment for each of predetermined areas, wherein the first traveling environment evaluation section sets, as the first traveling environment, a traveling environment indicating ease of driving of a vehicle based on information related to at least one of elements including a road environment, traffic conditions, and weather conditions;

a second traveling environment evaluation section configured to calculate an evaluation value of a second traveling environment for each of the predetermined areas, wherein the second traveling environment evaluation section sets, as the second traveling environment, a traveling environment indicating ease of driving of the vehicle based on parameters indicating a traveling state of the vehicle; and a display section configured to classify the evaluation values of the first traveling environment into a plurality of classes to obtain levels of ease of driving, wherein the display section displays the level of ease of driving for each of unit areas including one or a plurality of areas, wherein first unit areas including areas in a level displaced from a median of the classified levels of ease of driving exist when the display section enlarges a size of the unit areas to be displayed, the display section is configured to obtain the evaluation values of the second traveling environment of the areas in the level of ease of driving displaced from the median, and the display section is configured to display a level of ease of driving calculated based on the evaluation values of the second traveling environment as a replacement for the first unit areas including the areas in the level of ease of driving displaced from the median.

2. The traveling environment evaluation system according to claim 1, wherein when calculating the levels of ease of driving based on the evaluation values of the second traveling environment, the display section is configured to obtain the levels of ease of driving, which are obtained by classifying the evaluation values of the second traveling environment into a plurality of classes, and the median, and the display section is configured to set the level of ease of driving based on the evaluation value of the second traveling environment to the level to be displayed as a replacement by the display section on the condition that the level of ease of driving based on the evaluation value of the second traveling environment is displaced from the median of the second traveling environment.

3. The traveling environment evaluation system according to claim 1, wherein second unit areas not including the areas in the level displaced from the median exist when the unit areas to be displayed by the display section are enlarged, the display section is configured to calculate the levels of ease of driving of the second unit areas based on an average value of the evaluation values of the first traveling environment in the areas included in the second unit areas, and the display section is configured to display the calculated levels of ease of driving of the second unit areas for each of the second unit areas.

4. The traveling environment evaluation system according to claim 1, wherein the display section is configured to display the levels of ease of driving of the vehicle evaluated by the first traveling environment evaluation section or the second traveling environment evaluation section for each of the predetermined areas along with a road map of corresponding areas, and the display section is configured to enlarge the size of the first unit areas or the second unit areas to be displayed along with expansion of a scale of the road map corresponding to the first unit areas or the second unit areas.

5. The traveling environment evaluation system according to claim 1, wherein the display section is configured to determine that a level at which the level of ease of driving of the vehicle is lower than a predetermined value is the level displaced from the median.

6. The traveling environment evaluation system according to claim 1, wherein the vehicle includes a plurality of onboard control devices connected to a controller area network, and the second traveling environment evaluation section is configured to handle, as the parameters indicating the traveling state of the vehicle, parameters collected from the plurality of onboard control devices by communication prescribed in a CAN protocol.

7. The traveling environment evaluation system according to claim 1, wherein the first traveling environment evaluation section is configured to calculate the evaluation value of the first traveling environment by executing the processes of:

a) calculating a base score by numerically evaluating structural factors of a road to be evaluated based on road map data in which information related to the road map is registered;

b) expressing a factor in drop of ease of driving of the vehicle in a numerical form based on analysis of the traveling environment indicated by information related to at least one of elements of the road environment, the traffic conditions, and the weather conditions; and c) calculating an index numerically evaluating the ease of driving of the vehicle by subtracting the factor in drop of ease of driving of the vehicle expressed in a numerical form from the base score.

8. The traveling environment evaluation system according to claim 1, further comprising a management center that manages traveling information of a plurality of subject vehicles through wireless communication, wherein the second traveling environment evaluation section is provided in the management center, the second traveling environment evaluation section is configured to evaluate the second traveling environment for each of the predetermined areas based on vehicle information received from the plurality of vehicles to obtain evaluation values of the second traveling environment to distribute the evaluation values of the second traveling environment to each of the vehicles, the display section is provided on the vehicle, the display section is configured to calculate the levels of ease of driving based on the evaluation values of the second traveling environment distributed from the management center, and the display section is configured to display the calculated levels of ease of driving as a replacement.

9. The traveling environment evaluation system according to claim 1, further comprising a management center that manages traveling information of a plurality of subject vehicles through wireless communication, wherein the second traveling environment evaluation section is provided on each of the vehicles, the second traveling environment evaluation section is configured to evaluate the second traveling environment based on the vehicle information for each of the predetermined areas, the second traveling environment evaluation section is configured to transfer the evaluation values of the second traveling environment to the management center, the display section is provided on each of the vehicle like the second traveling environment evaluation section, the display section is configured to calculate the levels of ease of driving based on the evaluation values of the second traveling environment distributed from the management center, and the display section is configured to display the calculated levels of ease of driving as a replacement.

10. A traveling environment evaluation method executed by a traveling environment evaluation system, the method comprising:

calculating an evaluation value of a first traveling environment for each of predetermined areas by setting, as the first traveling environment, a traveling environment indicating ease of driving of a vehicle based on information related to at least one of elements including a road environment, traffic conditions, and weather conditions;

calculating an evaluation value of a second traveling environment for each of the predetermined areas by setting, as the second traveling environment, a traveling environment indicating ease of driving of the vehicle based on parameters indicating a traveling state of the vehicle;

classifying the evaluation values of the first traveling environment into a plurality of classes to obtain levels of ease of driving;

displaying the level of ease of driving for each of unit areas including one or a plurality of areas, wherein first unit areas including areas in a level displaced from a median of the classified levels of ease of driving exist at a time of enlarging a size of the unit areas to be displayed;

obtaining the evaluation values of the second traveling environment of the areas in the level of ease of driving displaced from the median; and displaying a level of ease of driving calculated based on the evaluation values of the second traveling environment as a replacement for the first unit areas including the areas in the level of ease of driving displaced from the median.

* * * * *